United States Patent [19]

Hesse et al.

[11] Patent Number: 4,525,773

[45] Date of Patent: Jun. 25, 1985

[54] LIGHT FIXTURE

[76] Inventors: Kurt Hesse, Nymphenburger Str. 4, D-1000 Berlin; Hartmut Engel, Schloss; Heutingsheim, 7141 Freiberg am Neckar, both of Fed. Rep. of Germany

[21] Appl. No.: 566,136

[22] PCT Filed: Apr. 20, 1983

[86] PCT No.: PCT/DE83/00073

§ 371 Date: Dec. 21, 1983

§ 102(e) Date: Dec. 21, 1983

[87] PCT Pub. No.: WO83/03885

PCT Pub. Date: Nov. 10, 1983

[30] Foreign Application Priority Data

Apr. 21, 1982 [DE] Fed. Rep. of Germany ..... 3214651

[51] Int. Cl.[3] ..... F21S 1/12

[52] U.S. Cl. ..... 362/413; 362/226; 362/287; 362/414; 362/427; 362/431; 362/449; 362/450; 339/8 A; 339/8 P

[58] Field of Search ..... 362/287, 226, 413, 414, 362/427, 431, 449, 450; 339/6 R, 6 A, 8 A, 8 P

[56] References Cited

U.S. PATENT DOCUMENTS

| | | | |
|---|---|---|---|
| 3,585,564 | 6/1971 | Skjervoll | 339/8 P |
| 3,955,079 | 5/1976 | Chapman et al. | 362/413 |
| 4,175,809 | 11/1979 | Dusko | 362/413 |

*Primary Examiner*—Stephen J. Lechert, Jr.

*Attorney, Agent, or Firm*—Pollock, Vande Sande and Priddy

[57] ABSTRACT

In a light fixture with a lamp fixture carrier, a tube surrounding at least one current lead, and a carrier part for the tube, the tube can be connected to the carrier part and the lamp fixture carrier. The tube and the receptacle areas for the tube ends have contact pins or contact sockets, respectively, which are connected to each other. These contact pins and contact sockets have contact surfaces that are arranged concentrically to each other and to the central axis of the tube, and the joined parts are pivotable on the tube and around the central axis of the corresponding tube end. Such a light fixture can be put together in various configurations without any wiring.

6 Claims, 10 Drawing Figures

LIGHT FIXTURE

TECHNICAL AREA

Figure 1:
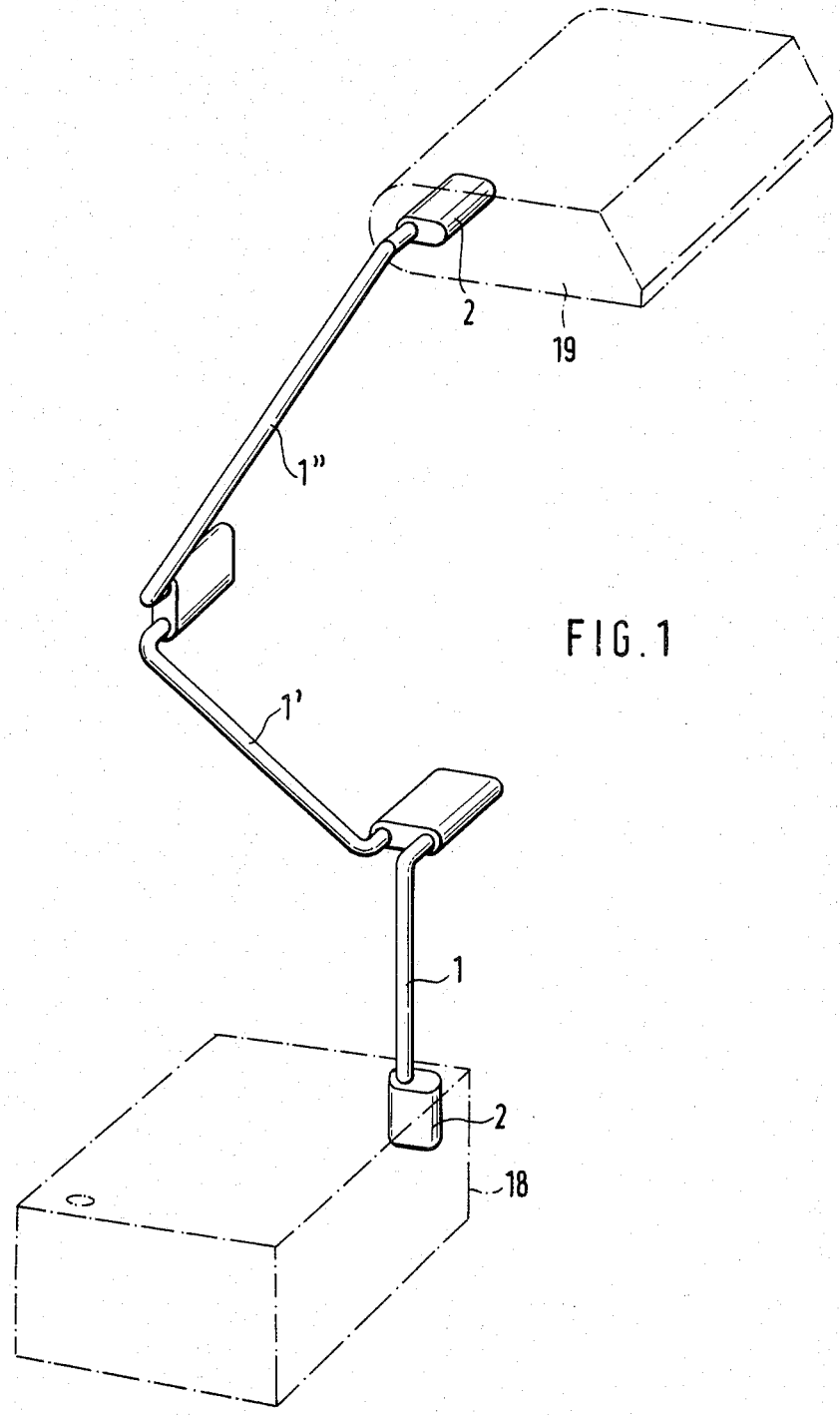

The invention concerns a light fixture with a carrier for the lamp fixture, a tube which surrounds at least one current conductor and mounting part for the tube.

STATE OF THE ART

Known light fixtures of this type are common standing lamps in which a cable runs through the foot part and the tube is led to the lamp fixture carrier and to lamp fixture. The electric cable is firmly wired in.

In so-called work area fixtures, consisting of several tubes and joints, the wiring is either through the tubes and joints or along the tubes. When the wiring is led through the inside, there are technical and esthetical problems on the joints. The wires led on the outside greatly interfere with the esthetic possibilities.

For this reason there have already been suggestions for work place light fixtures in which the carrier rods form also the current conductors. The carrier rods are electrically insulated from each other. The use of open current conductors is only possible in the low voltage range. However, even in the low voltage range there is the problem that short circuits could occur between the open current conductors.

THE INVENTION

The invention is based on the problem to make light fixtures of the type mentioned in the beginning in such a manner that they can be assembled without further wiring from the various parts in a detachable and variable manner.

This problem is solved by the fact that the tube can be pushed together with the carrier part and the lamp fixture carrier, whereby the tube and the receptacle areas for the tube ends in a pushed together position have connected, central contact pins - firmly attached to the parts - or contact sockets which have contact surfaces that are arranged in a concentric manner to each other and to the center axis of the tube, whereby the pushed together parts are pivotable against the tube and the center axis of the corresponding tube end.

According to another characteristic of the invention the tube can be locked to the attached parts.

Further more, it is suggested that several tubes are mechanically and electrically combinable through tube joining sleeves and contact pins or sockets mounted in them.

It has proven suitable that the inside tube end has all around a groove, perpendicular to the tube axis, into which a spring mounted in the corresponding piece fits.

For this purpose, the spring preferably sits in the inside groove of a counter piece on the attached part, fitting over the tube end, whereby the inside diameter of the counter piece corresponds at least approximately to the outside diameter of the tube end.

Such a light fixture can be combined in random shapes and combinations. The connections between the various parts of the fixture can be done extremely simply, even by the user, and without tools. By choosing certain tube and connecting pieces, he can create various light fixtures. There are essentially no limits to the variation possibilities. By mounting the electric lines inside the tubes, esthetically pleasing fixtures can be created. When using suitable metal tubes, the tubes themselves can be used as current of grounding leads.

The arrangement of the electrical connector elements in the front sides of the parts to be joined permits an esthetically very pleasing construction of the connecting parts, as the plug elements can be made very small. It is possible, e.g., to use tubes with an outside diameter of 6 to 8 mm, whereby it is possible to comply with electrical testing regulations in spite of the small diameter.

According to another suggestion in the invention, the ends of two tubes can be connected by means of a connecting piece which has two parallel channels to accept tube ends, which have electrical contact pins or sockets for connection to the corresponding counter piece in the tube ends.

In this case, the connector piece consists of two plate like half bowls, whereby each has about half of the accepting channels and which can be put together with a connecting screw. Such connecting pieces are especially advantageous if the tube ends are angled, i.e. if the reception channels extend perpendicular to the length axis of the tubes. When using such plate shaped half bowls, fixtures are created, which are especially esthetically attractive, but are still very stable in spite of the thin construction of the tubes.

According to another suggestion of the invention, there is a spring mounted in the connecting pieces which grips simultaneously into the grooves of both inserted tubes.

Finally, the invention also suggests that at the end of both accepting channels a connecting piece with two contact pins or contact sockets which reach into the front of the channels be mounted, whereby the contacts electrically connect these electrical contact pieces with each other.

Figure 2:
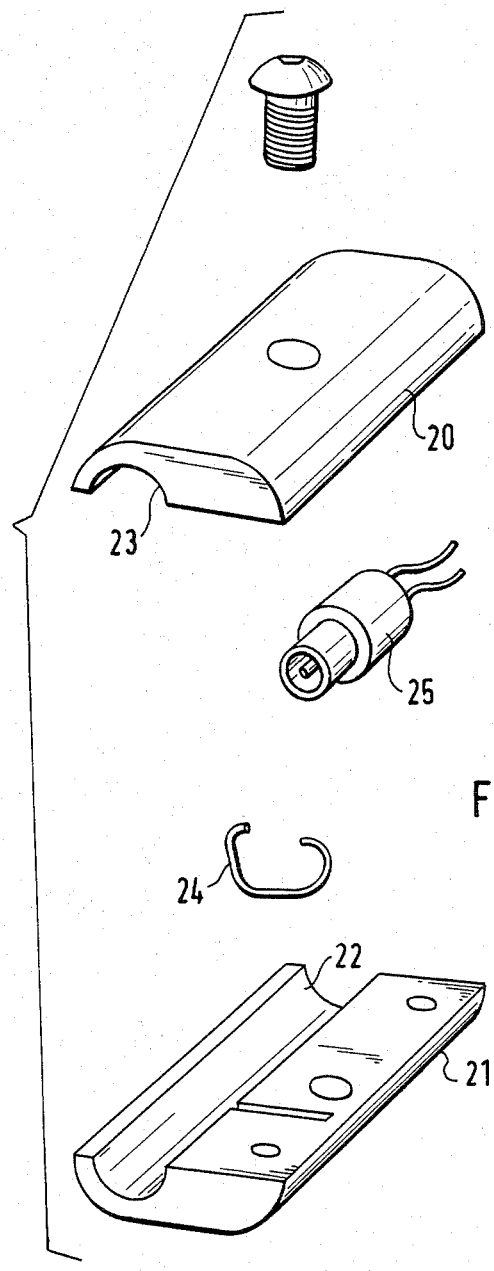
Figure 3:
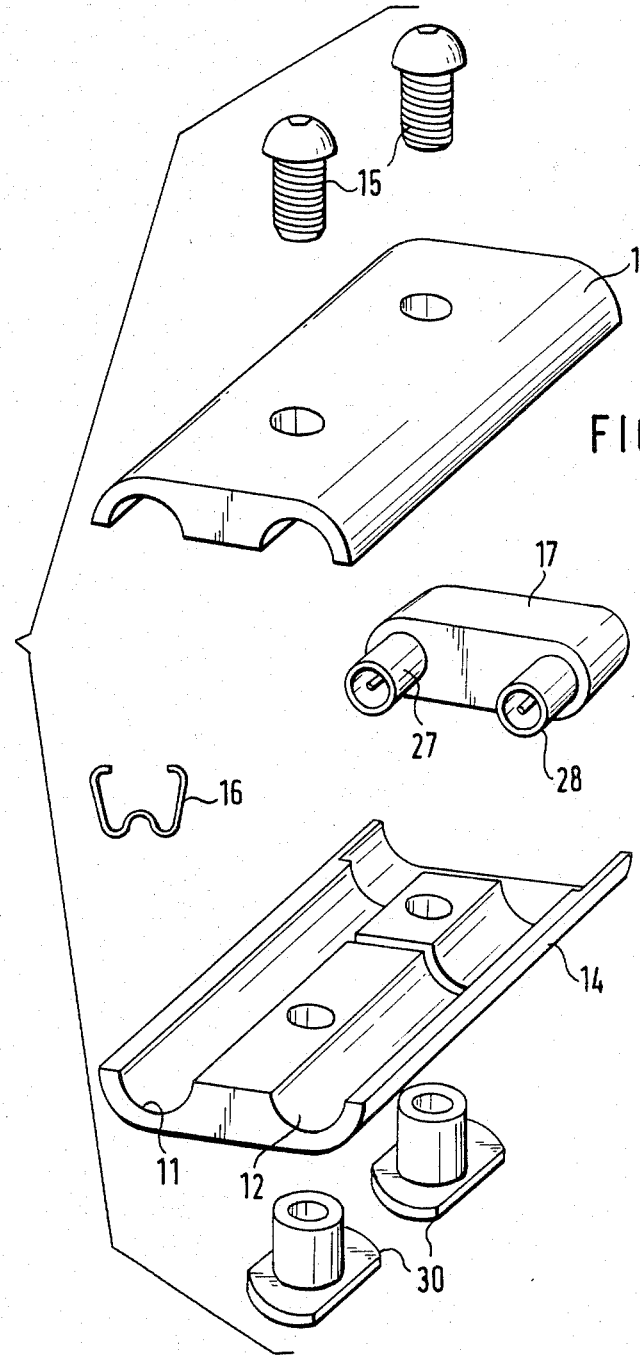
Figure 4:
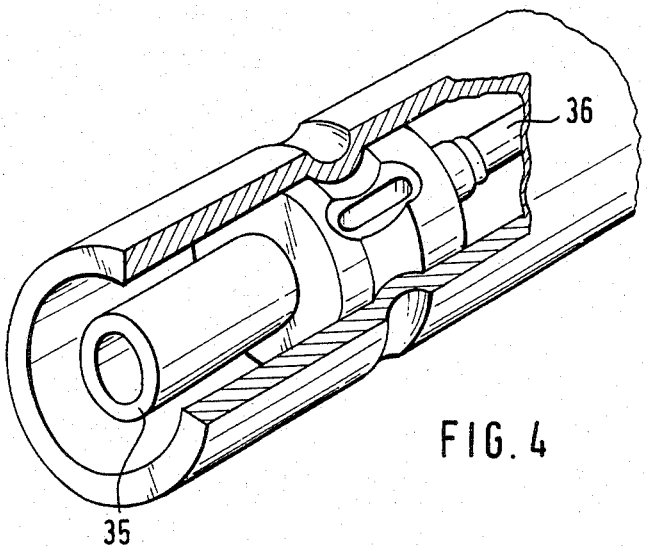
Figure 5:
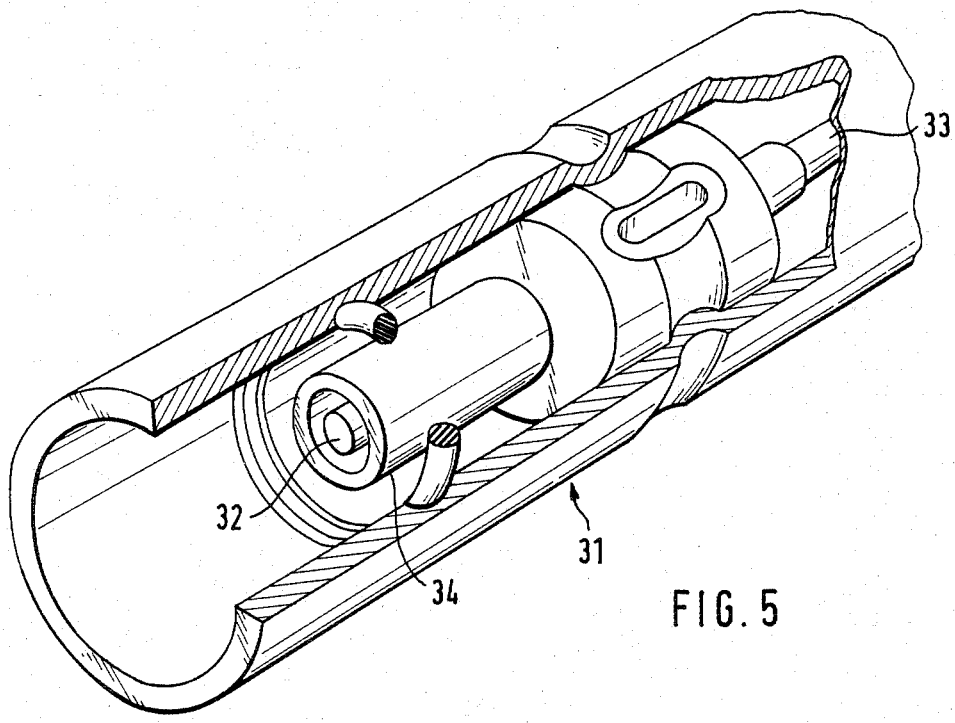
Figure 6:
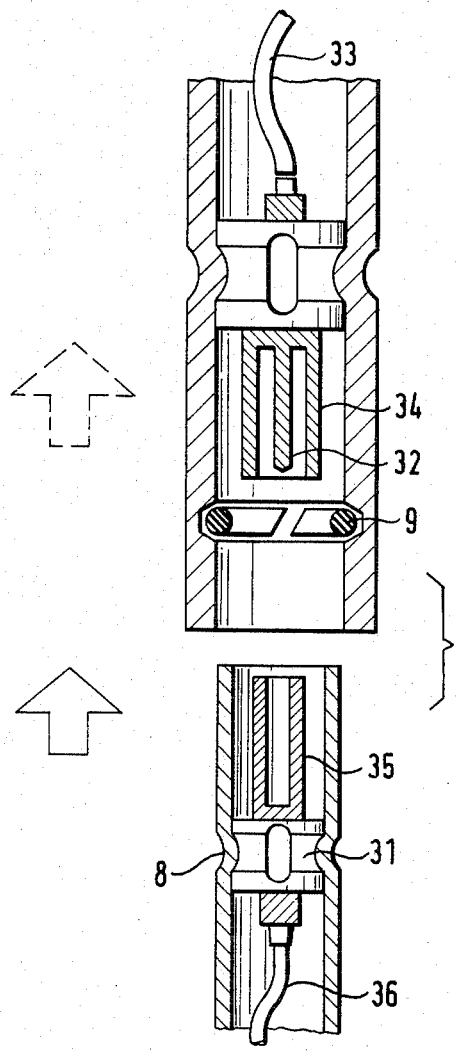
Figure 7:
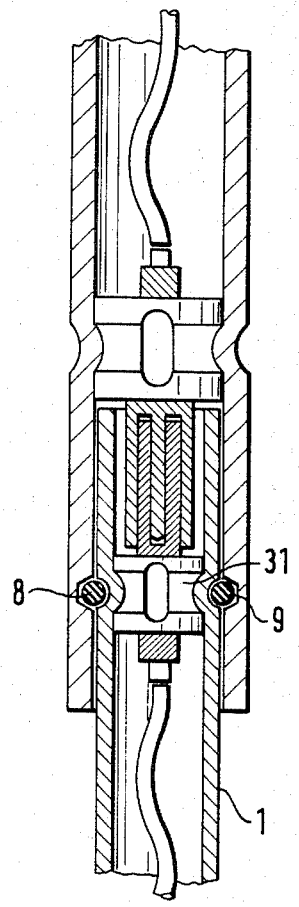
Figure 9:
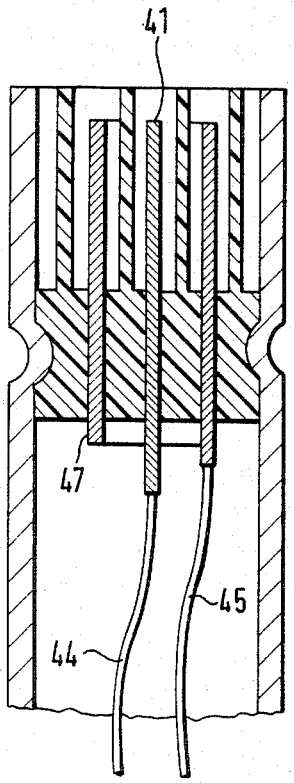
Figure 8:
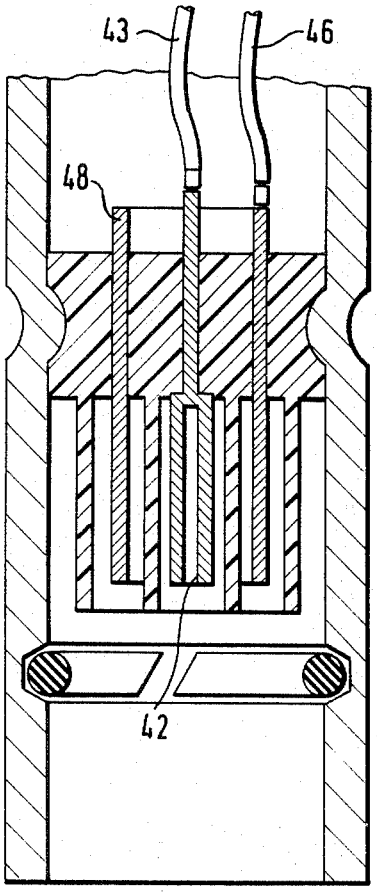
Figure 10:
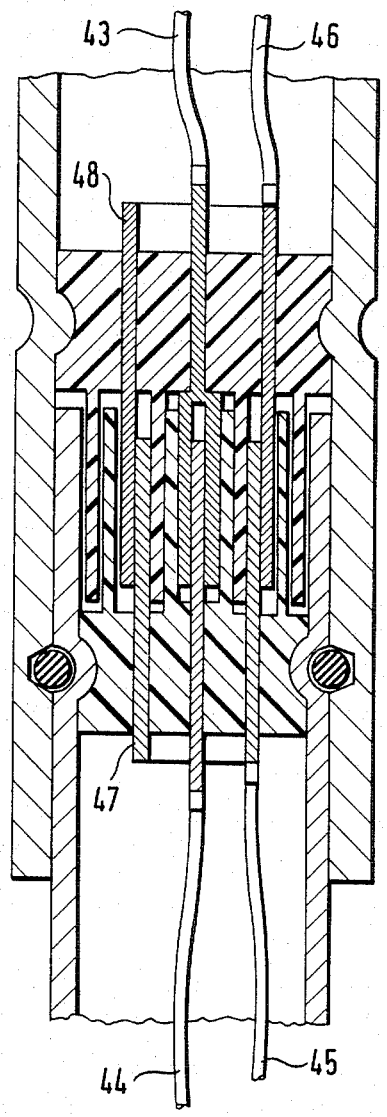

Subsequently the preferred models of the invention are described in detail, using the drawings. They show:

SHORT DESCRIPTION OF THE DRAWING FIGURES:

FIG. 1. a schematic representation of a multi joint light fixture,

FIG. 2. an expansion drawing of the receptacle piece for the tube ends, which are designed for use at the reflector or lamp fixture holder and in the fixture foot, FIG. 3. an expansion drawing of a connecting piece for angled tube ends, FIG. 4. a perspective, partially cut open representation of a tube end with the contact elements on the front side, FIG. 5. the counter piece to the element in FIG. 4 in a similar representation, FIG. 6. two corresponding end pieces in pulled apart condition and lengthwise cut, FIG. 7. the two end pieces according to FIGS. 4 to 6 in contact in a lengthwise cut representation, FIG. 8. a cut through a tube end or part with contact sockets or contact pins for two current leads, FIG. 9. the counter piece to the element according to FIG. 8, FIG. 10. the two parts according to FIGS. 8 and 9 in contact in a lengthwise cut representation.

BEST WAY TO EXECUTE THE INVENTION

In FIG. 1 a light fixture with joints is shown. This joint fixture has a foot part 18, into which a holder part 2 for the tube 1 is fitted. Tube 1 can have various shapes. It can be angled, e.g., as shown in the lower part of FIG. 1, it can also be trimmed on both ends, as shown in the upper part of FIG. 1, but it can also be straight. As only the basic construction of tube 1 is of concern, all tubes are designated in the same manner and are only differentiated by the superscript.

The upper tube 1'' reaches, with its angled part, also into the carrier part 2, which is mounted into a fixture holder 19 which is shaped as a reflector part.

The carrier part 2 is shown more clearly in FIG. 2. It consists of two half-bowl shaped parts 20 and 21 with borings that form channels 22 and 23 when the two halves are put together. A holding spring 24 reaches into the through boring formed by the channels 22 and 23. The two half-bowls accept the contact sockets between them and are held together by the screw 26. The connector part 10 is made similarly to the carrier part 2, whereby connector part 10 has two parallel channels 11 and 12, formed by combining two plate shaped half-bowls 13 and 14 which are held together by the connecting screw 15. A holding spring 16 reaches with one segment each into one of the two channels 11 and 12.

At the end of the two channels an electrical connector piece 17 - containing two contact sockets 27 and 28 which are electrically connected - is inserted between the two half-bowls 13 and 14. The nuts for the connecting screws 15 are designated by 30.

The construction of the ends of the tubes 1 or their corresponding counter parts - which can be arranged either in fixture parts, carrier parts, connector tubes or other tubes - can be seen from FIGS. 4 to 7.

A first plug part 31 has a contact pin 32 in its center, which is connected to an electric wire 33. The contact pin 32 is surrounded by a sleeve 34. A corresponding counter part, shaped as a socket 35, is contained in the opposing tube end (see FIG. 6). This socket 35 is electrically connected with the cable 34, led through the inside of the tube. The connected position shown in FIG. 7 results from their being pushed together. In the connected position, the connecting spring 9 sits in the groove 8 of the end piece of tube 1.

In the model according to FIGS. 8 and 9, a central contact pin 41 is provided for, which corresponds to a socket-like counter piece 42. Parts 41 and 42 carry the current from the leads 43 and 44.

Two other current carriers 45 and 46 end in two metallic, concentrically arranged sockets 47 and 48 which are adjoining each other. Even in this arrangement of tubes, which contain several leads, a pivotability of the connected tubes or parts around the tube axis is assured.

It is possible to think of other plug arrangements, in which in each case the contact surfaces are concentric to the tube axis. It is unimportant, in this case, which part of the corresponding plugs is located in which of the connected parts. It is possible to arrange the sockets and contact pins in an insulated manner in carrier parts, formed accordingly, from extruded synthetic materials.

We claim:

1. Light fixture with a lamp fixture carrier, a tube which surrounds at least one current carrier, and a carrier piece for the tube, characterized by the fact that said tube can be pushed together with said carrier piece and the lamp fixture carrier, the tube and the receptacles for the ends of the tubes, when pushed together, having connecting fixed contact pins or contact sockets, centrally attached to the corresponding parts, which have contact surfaces that are arranged concentrically to each other and to the central axis of the tube, whereby the connected parts are pivotable relative to the tube around the central axis of the corresponding tube end, a holding groove being provided in the inside tube end, into which a holding spring in a corresponding counter piece locks.

2. Light fixture according to claim 1, characterized by the fact that the locking spring is located in the inside groove of the overlapping counter piece of the attached part, whereby the inside diameter of the counter piece is at least approximately similar to the outside diameter of the tube end.

3. Light fixture according to one of the claims 1 or 2, characterized by the fact that the ends of two tubes can be connected by a means of a connector part, which contains two parallel receiving channels to accept tube ends, which are fitted with electrical contact pins or contact sockets for connecting the corresponding counter pieces in the tube ends.

4. Light fixture according to claim 3, characterized by the fact that the connector part consists of two plate shaped half-bowls, each containing approximately half of the receiving channels, and which can be connected by means of a connecting screw.

5. Light fixture according to claim 4, characterized by the fact that the holding spring is fitted into the connector piece, which reaches simultaneously into the holding grooves of both plugged in tube ends.

6. Light fixture according to claim 5, characterized by the fact that at the end of the receiving channels a connecting piece (17) with two contact pins or contact sockets, reaching from its front into the channels, is fitted in, whereby the contacts of this electrical contact piece are connected with each other in an electrically conducting manner.

* * * * *